United States Patent [19]

Greb

[11] 4,320,549

[45] Mar. 23, 1982

[54] ROCKER-SLIDING BEARING ASSEMBLY AND A METHOD OF LINING THE ASSEMBLY

[75] Inventor: Gerhard Greb, Mücke, Fed. Rep. of Germany

[73] Assignee: Glacier GmbH-Deva Werke, Stadtallendorf, Fed. Rep. of Germany

[21] Appl. No.: 54,916

[22] Filed: Jul. 5, 1979

[30] Foreign Application Priority Data

Jul. 4, 1978 [DE] Fed. Rep. of Germany ..... 2829309

[51] Int. Cl.[3] ..... B21D 53/10; E01D 19/04

[52] U.S. Cl. ..... 14/16.1; 52/167; 308/3 R; 308/DIG. 3; 29/149.5 R

[58] Field of Search ..... 14/16.1; 308/3 R, 244, 308/DIG. 3; 52/167; 51/DIG. 14

[56] References Cited

U.S. PATENT DOCUMENTS

| | | | |
|---|---|---|---|
| 2,359,036 | 9/1944 | Harper | 14/16.1 X |
| 2,680,259 | 6/1954 | Milk | 14/16.1 |
| 3,329,472 | 7/1967 | Donnezlan | 14/16.1 X |
| 3,347,002 | 10/1967 | Penkuhn | 52/167 |
| 3,397,016 | 8/1968 | Delforce | 14/16.1 X |
| 3,398,998 | 8/1968 | Burnett | 14/16.1 X |
| 3,436,129 | 4/1969 | James | 14/16.1 X |
| 3,703,014 | 11/1972 | Koester | 14/16.1 |
| 3,762,114 | 10/1973 | Eskijian | 52/167 |
| 3,971,598 | 7/1976 | Rudge | 308/3 R |

FOREIGN PATENT DOCUMENTS

| | | |
|---|---|---|
| 1261153 | 2/1968 | Fed. Rep. of Germany . |
| 6911543 | 3/1969 | Fed. Rep. of Germany . |
| 421167 | 3/1967 | Switzerland . |
| 586793 | 4/1977 | Switzerland . |

*Primary Examiner*—Nile C. Byers, Jr.

*Attorney, Agent, or Firm*—Oblon, Fisher, Spivak, McClelland & Maier

[57] ABSTRACT

A rocker-sliding bearing for bridges or similar structures and a method of lining the concave top side surface of a curved baseplate of a rocker-slider bearing wherein the rocker-slider bearing includes a flat top plate, an intermediate plate having a flat top side and a convex curved underside surface, a bedplate and a baseplate having a correspondingly concave curved top side surface in turn secured to the bedplate, the curved surface on the top of the baseplate including a lining of corrosion-resistant material and the curved surface of the intermediate plate including a lining with a low coefficient of friction relative to the highly corrosion-resistant material on the curved surface of the baseplate wherein the lining on the curved surface of the baseplate includes a preformed curved disc positioned on the baseplate and secured to the concave top side thereof.

11 Claims, 6 Drawing Figures

ROCKER-SLIDING BEARING ASSEMBLY AND A METHOD OF LINING THE ASSEMBLY

BACKGROUND OF THE INVENTION

1. Field of the Invention

The invention relates to a rocker-sliding bearing for bridges or similar structures including a flat top plate, an intermediate plate having a flat top side and a concave curved underside, and a baseplate having a correspondingly concave curved top side in turn secured to a bedplate, the curved surface on the top of the baseplate being provided with a lining of efficiently corrosion-resistant material and the curved surface of the intermediate plate being lined with a material which has a low coefficient of friction relative to the highly corrosion-resistant material on the curved surface of the baseplate. The invention also relates to a method of lining the concave top side of the baseplate of the aforementioned rocker-sliding bearing.

2. Description of the Prior Art

Rocker-sliding bearings for bridges or other structures, which have to bear heavy loads, usually have spherical sliding surfaces in the form of a frictional combination of PTFE and hard chromium. The PTFE layer is usually applied to cavities in the concave top side of the base of the bearing, whereas the curved underside of the intermediate plate or "cap", which abuts the PTFE layer and is convex to match the concave underlayer, has its surface lined with hard chromium. It has previously been attempted to insert the PTFE layer in the convex surface of the cap, whereas the concave top side of the base of the bearing is provided with a hard chromium layer.

It has been found, however, that it is relatively expensive to coat the aforementioned spherical, particularly concave, surfaces with hard chromium, and it is difficult to give the layer the required uniformity. A fairly large amount of manual labor is also required for the preliminary polishing before chromium-plating and, more particularly, is also necessary after the plating. It is also necessary to apply an anti-corrosive layer having good frictional properties.

Previously published licences of bridge bearings by the Institut fur Bautechnik, Berlin, relate exclusively to the use of PTFE on one frictional side, whereas a layer of hard chromium is applied to the other frictional side. This means that bearings hitherto licensed by the building authorities have been plated with hard chromium, with all the attendant difficulties.

SUMMARY OF THE INVENTION

One object of the invention, accordingly, is to improve the bearing of the initially-mentioned kind so that, without reducing the usefulness of the bearing, it is unnecessary to apply a layer of hard chromium to the concave surface and the bearing is particularly economical to manufacture. Another aim is to devise a method by which the concave surface of the baseplate can be lined without applying a layer of hard chromium.

To this end, in the case of a rocker-sliding bearing of the initially-described kind, the lining on the concave top side of the baseplate is a preformed curved sheet of non-rusting steel which is placed on the baseplate and secured to the concave top side thereof. The parts can be very easily secured together in a desired manner by sticking the preformed curved disc on the baseplate in a shear resistant manner, thus reliably avoiding the risk that the curved disc will rust underneath. Additionally (or alternatively) the outer peripheral region of the disc may advantageously be screwed to the baseplate by countersunk screws.

According to another advantageous feature of the slding bearing of the present invention, the outer periphery of the preformed curved disc is secured by a retaining ring against the concave surface of the baseplate and, according to another advantageous feature the inner surface of the retaining ring has a sloping portion bearing against a matching slope on the outer periphery of the disc, thus firmly pressing the disc against its seat. In accordance with another feature of the present invention, on the inside of the retaining ring there is provided a lower slope which bears against a matching slope on the outer periphery of the disc and which also merges upwardly into a radially inwardly extending retaining ring projection against which the upper peripheral edge of the disc bears. In this manner the disc is positively and non-positively pressed against the baseplate, and advantage can also be taken of a centering effect. A further advantageous feature of the present invention resides in the retaining ring having a rounded internal bead which presses the edge region of the disc downwardly against the baseplate. In all the features where a retaining ring is used, the ring is preferably pressed by screws against the baseplate. A suitably large or variable pressure against the disc which is to be secured can be applied simply by varying the number of screws. If the disc is not stuck but instead just screwed or pressed against the baseplate, it is advisable to prevent the disc from rusting underneath by providing an anti-corrosion layer on the concave surface of the baseplate against which the disc is pressed. A simple, preferably corrosion-resistant layer can be obtained by means of a double "priming coat" in a region having a layer thickness of about 50 $\mu$m. If a retaining ring is used to clamp the disc against the baseplate, the clamping forces can be increased by increasing the number of retaining screws and, in addition, the spherical part can be held down with adequate long-term reliability.

The inventive features can be carried out without great difficulty and provide an acceptable, reliable solution of the problem, thus avoiding the difficulties of treating the aforementioned concave surfaces with hard chromium. In addition, a considerable reduction can be made in the time necessary for manufacture the aforementioned bearings since the parts can be simultaneously acquired and processed. The rocker-sliding bearings according to the invention may also be very economical to produce in that preformed convex discs according to the invention (usually with spherical curvature) can be easily purchased. The curved discs used according to the invention can be easily manufactured with the required uniformity and the necessary tolerances, as tests have shown. The lining according to the invention is very simple since the preformed disc can be made from sliding sheet-metal which can be commercially obtained and already has the described surface quality. The aforementioned selected securing methods are completely satisfactory with regard to the required operational reliability, and the bearings can be constructed without difficulty with the required accuracy.

Particularly good results can be obtained if, in a bearing constructed according to the invention, the surface of the preformed convex disc remote from the baseplate is ground and polished. As already mentioned, commercially pretreated sheets can be used.

In an advantageous embodiment of the invention, the preformed curved disc is made of austenitic sheet steel preferably between 0.75 and 5 mm thick. It is advantageous for the austenitic steel sheet to be a non-rusting sheet of a chromium-nickel-molybdenum alloy; the material preferably being No. 1.4401 to DIN 17440 (name of material: ×5 Cr Ni Mo 18 10).

In order to obtain particularly advantageous frictional conditions in the spherical friction surface, according to a very advantageous feature of the present invention, the lining of material facing the preformed curved disc on the underside of the intermediate plate is made of PTFE and is formed with lubricating cavities filled with lubricant on its surface facing the preformed disc.

The method according to the present invention is based on a method of lining the concave surface of the baseplate of a rocker-sliding bearing, wherein a lining of efficiently corrosion-resistant material is applied to the curved surface of the bearing baseplate so as to correspond to the aforementioned surface. Moreover, a plate of non-rusting sheet steel is suitably curved and preformed separately from the bearing so as to match the curved surface of the bearing baseplate, and is then placed on the curved surface of the baseplate and secured thereto. The method according to the invention is simple and rapid and commercial metal sheets can be used.

In an advantageous embodiment of the method, the sliding surface of the preformed curved disc is polished and ground before the disc is inserted. Preferably, the sliding surface of the disc is polished and ground before the disc is preformed, for matching the curved surface of the baseplate. As indicated before, suitable pretreated non-rusting austenitic steel sheets are commerically available. Preferably, the dish is connected to the baseplate by sticking and/or screwing and/or clamping.

The invention reliably obviates all the difficulties in the prior art methods or applying a surface layer of hard chromium, and manufacture is also very economical. The bearings according to the invention can also be produced more quickly and can be made very uniform.

In a preferred embodiment of the method according to the invention, when the dish is stuck to the baseplate, the dish is made of sheet-metal having a thickness of less than 2 mm, preferably 1 mm or less. It is thus easy to subsequently shape the material during assembly and sticking. If thicker metal is used, relatively high forces are required for subsequent shaping during assembly and these may exceed the permitted load on the adhesive layer so that it becomes unstuck. If thinner metal is used in the aforementioned manner, more particularly in the aforementioned regions, the preshaped dish can be easily secured to the substrate by a suitable metal adhesive and, as previously stated, after the adhesive has set the pre-bent dish can also be held by countersunk screws at its outer edges or by using a retaining ring. Furthermore, if an adhesive is used, the steel surface need not be given additional pretreatment to avoid rusting underneath. If no securing adhesive is used, the curved surface of the baseplate should be given an anticorrosive coatin, advantageously in the form of a double priming coat, before the dish is inserted.

In an advantageous embodiment of the method of the present invention, in the case where no adhesive is provided, the center region of a disc is bent slightly too much and then positively and/or non-positively pressed into its final position on the curved surface of the baseplate, using a retaining ring acting on its outer region.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
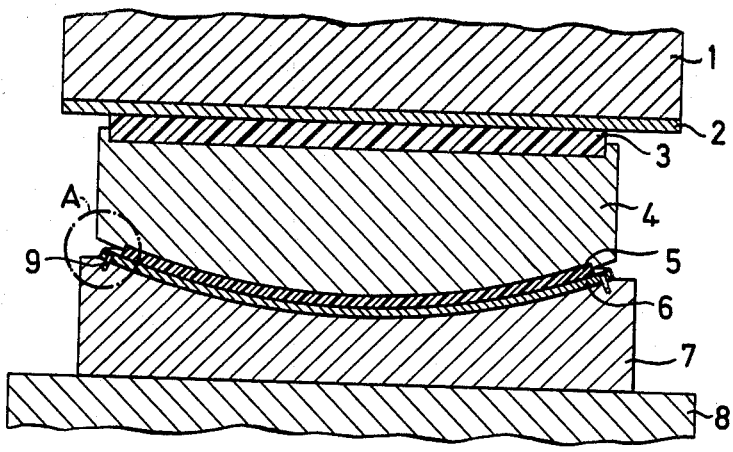
FIG. 1 is a schematic lateral view of a rocker-sliding bearing according to the present invention.

FIG. 1 shows a rocker-sliding bearing having a top plate 1 which has a flat underside and a lining 2 which efficiently resists corrosion. Lining 2 can be of suitable non-rusting sheet steel or can be a coating of hard chromium.

The bearing has an intermediate plate 4 which has a flat top side formed with recesses holding a PTFE layer projecting somewhat above the flat surface of plate 4 and is in (frictional) contact with lining 2 on plate 1. The underside of the intermediate plate 4 has a spherical curvature—i.e. is a spherical cap in the example shown. It likewise is formed with recesses into which a suitably shaped PTFE plate 5 is inserted and abuts a non-rusting lining on the top of a baseplate 7, which is of a correspondingly concave configuration. This "anti-corrosion layer" is in the form of a disc 6 which has previously been bent to match the concavity of the curved surface of baseplate 7 and, in the example shown, is secured to baseplate 7 by an adhesive layer 10 (FIG. 2), its edge region also being secured by countersunk screws 9 (FIGS. 1 and 2) inserted in bores 12 (FIG. 3). Baseplate 7 in turn is placed on a suitable bed plate or foundation 8, not shown in detail in FIG. 1.

Figure 2:
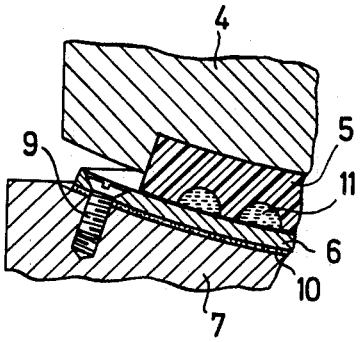
FIG. 2 is an enlarged-scale view of detail A from FIG. 1.
Figure 3:
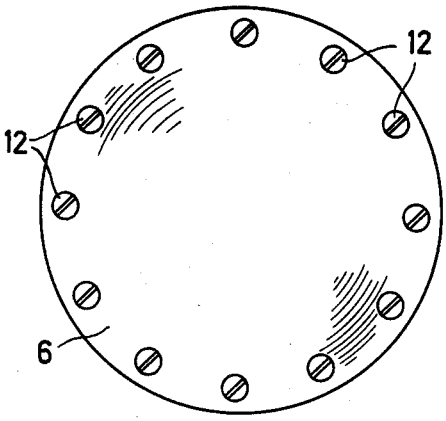
FIG. 3 is a plan view of a preshaped disc for lining the concave surface of the bottom part of a bearing according to the invention.

As FIG. 2 shows, the recessed frictional plate 5 of PTFE in the curved under-surface of plate 4 is formed with cavities 11 on its side facing the baseplate. The cavities are filled with lubricant so as to permanently lubricate the spherical sliding surface. The surface of the pre-shaped disc 6, i.e. that side of disc 6 which faces the PTFE layer secured to the bottom of the intermediate plate, is ground and polished. The concave top surface of baseplate 7 is lined as discussed hereinbelow. Firstly, baseplate 7 is manufactured in its exact shape; in the process (or simultaneously and independently) the required precurved disc 6 is made by suitably shaping an ordinary commercially-obtainable metal plate which has already been polished and ground. The curved dishes are then inserted in the concave surface of baseplate 7 and suitably interconnected, e.g. by a layer of adhesive which has already been applied to baseplate 7 or to the underside of the disc, or by countersunk screws at the boundary region of the pre-curved dish.

The screws can be the only securing means or can be utilized in addition to the adhesive.

For simplicity, the drawings of the rocker-sliding bearing do not show those features, e.g. lateral seals, which are necessary or conventional in the aforementioned rocker-sliding bearings and are well known to the skilled addressee.

The round shape of disc 6 shown in FIG. 3 is only one possible embodiment of the aforementioned disc or plate. In theory, disc 6 can have any suitable shape, even if not round, and more particularly can be a polygon (e.g. a octagon), in which case each side is at a tangent to the internal or useful diameter of disc 6.

Figure 4:
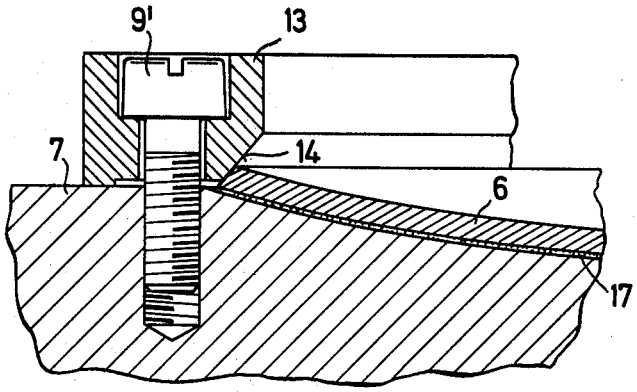
FIGS. 4–6 are schematic detailed views showing various forms of clamping the preshaped disc to the baseplate by a retaining ring.
Figure 5:
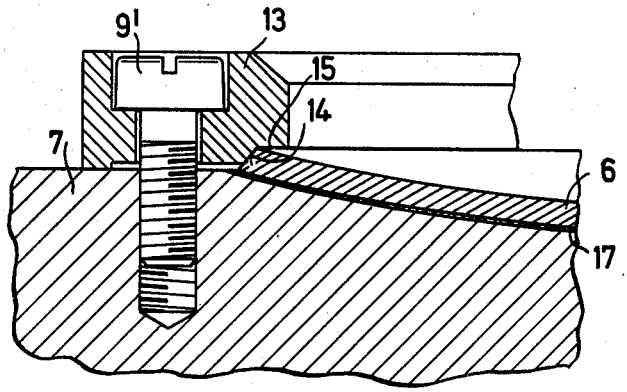
Figure 6:
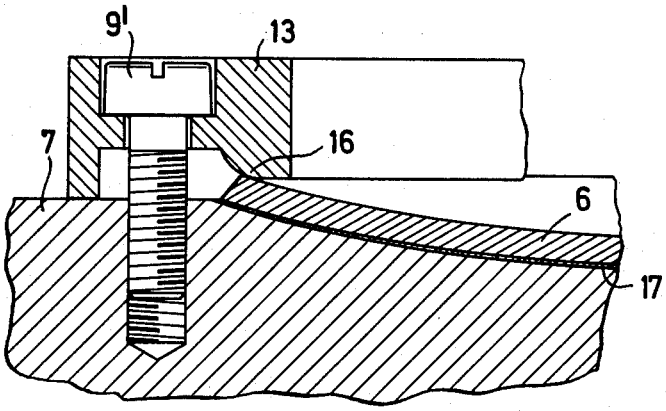

FIGS. 4–6 show various basic possible methods of mechanically securing the bearing surface of disc 6 by using a retaining ring which can be secured to baseplate 7 by screws 9'. If disc 6 is clamped in this purely mechanical manner, it need not be stuck to the baseplate 7, and there is therefore a risk that it will rust underneath. For this reason, baseplate 7 is given an anti-corrosive lining 17, at least in the neighborhood of the area which bears the disc 6. Lining 17 may advantageously be a double priming coat, having a thickness of approximately 50 μm.

In the embodiment shown in FIG. 4, the retaining ring 13, which is secured by screws 9' to baseplate 7, has a slope 14 at the bottom of its inner side, bearing against a corresponding slope at the end of disc 6. If ring 13 is secured by screws 9' against baseplate 7, disc 6 is additionally clamped against baseplate 7 by the wedge effect between the sloping surfaces of ring 13 and disc 6, until the disc is completely adapted to the substrate and adheres completely and firmly.

In the embodiment of FIG. 5, the retaining ring 13 likewise has a slope 14 at its inner side but, in contrast to the embodiment in FIG. 4, the slope is not made appreciably longer than the slope in the pre-curved disc 6. In FIG. 5, slope 14 merges directly with a radially inward projection 15 on retaining ring 13, directly at the top outer edge of the curved disc 6, so that when ring 13 is secured to baseplate 7, a wedge effect similar to the example in FIG. 4 is exerted by slope 14, but, since an angle is formed between slope 14 and projection 15, disc 6 abuts projection 15 and cannot escape upwardly. In addition, the end of disc 6 also presses down on the abutment at the aforementioned place.

Likewise in the embodiment shown in FIG. 6, the retaining ring 13 has a downwardly rounded internal bead 16 which presses the end region of the pre-curved disc 6.

In the embodiments shown in FIGS. 4–6, the pre-curved disc 6, before being placed on baseplate 7, is shaped by slightly excessively bending it at its center (e.g. the radius of curvature therein being somewhat less than the corresponding radius of curvature on baseplate 7). If the resulting disc 6 is then placed on baseplate 7, the end region of plate 6 is located at a distance from the associated bearing surface. This distance is reduced to nothing by exerting mechanical pressure via the retaining ring 13 thus ensuring that the end region of disc 6 also abuts the bearing surface on baseplate 7 and also builds up tension inside disc 6 such that disc 6 bears on substrate 7 in a particularly firm, close manner.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A rocker-sliding bearing for bridges or similar structures comprising:

a flat top plate;

an intermediate plate having a flat top side and a convex curved underside surface;

a bed plate;

a base plate having a correspondingly concave curved top side surface of a predetermined first radius of curvature secured to said bed plate;

a preformed curved disc of corrosion-resistant steel having a predetermined radius of curvature which is less than said first radius of curvature of said base plate top side surface positioned on the base plate; and means for securing said steel disc to said base plate and for pressingly abutting said steel disc so as to conform to said predetermined first radius of curvature of said base plate top side surface.

2. A rocker-sliding bearing according to claim 1, said means for securing said disc comprising countersunk screw members screwed into said base plate.

3. A rocker-sliding bearing according to claim 1, said means for screwing said disc comprising a keeper ring and means for fixing said keeper ring on said base plate on said top side surface of said base plate.

4. A rocker-sliding bearing according to claim 3, wherein said keeper ring has a sloping face portion and said steel disc has a circumferential sloped surface wherein said sloping face portion of said keeper ring engages said circumferentially sloped surface of said steel disc.

5. A rocker-sliding bearing according to claim 4, wherein said keeper ring includes a radially inwardly projecting portion which engages a top outer edge portion of said steel disc.

6. A rocker-sliding bearing according to claim 4, said keeper ring further comprising a downwardly extending, rounded internal bead portion which engages a top outer edge portion of said steel disc.

7. A rocker-sliding bearing according to claims 1, 2, 3, 4, 5 or 6, wherein said steel disc comprises austenitic steel sheet having a thickness in the range of 0.75 mm to 5 mm.

8. A rocker-sliding bearing according to claims 1, 2, 3, 4, 5 or 6, further comprising a lining disposed on the underside of the interemediate plate which comprises polytetrafluoroethylene and includes a plurality of lubricating cavities formed therein on a surface portion thereof facing the steel disc, and further comprising lubricant disposed in said lubricating cavities.

9. A method of lining a concave top side surface of a curved base plate, having a predetermined first radius of curvature on said top side surface thereof, of a rocker-sliding bearing for allowing tilting motion of a structure supported thereby which comprises:

grinding a surface of a corrosion-resistant steel sheet disc to form a sliding surface;

preforming said corrosion-resistant steel sheet disc so as to form a second predetermined radius of curvature which is less than said first radius of curvature of said base plate top side surface; and securing said steel sheet disc to said base plate top side surface so as to conform to said predetermined first radius of curvature of said base plate top side surface.

10. A method as set forth in claim 9, wherein said securing step comprises screwing said steel sheet disc to said base plate top side surface.

11. A method as set forth in claim 9, wherein said securing step comprises clamping said steel sheet disc to said base plate top side surface.

* * * * *